US007918715B2

(12) United States Patent
Clark et al.

(10) Patent No.: US 7,918,715 B2
(45) Date of Patent: Apr. 5, 2011

(54) DEVICE AND METHOD FOR SHARPENING BLADES

(75) Inventors: Randel R. Clark, Mayville, WI (US); Charles S. Steele, Brownsville, WI (US)

(73) Assignee: Glacier Ridge Engineering, LLC, Brownsville, WI (US)

( * ) Notice: Subject to any disclaimer, the term of this patent is extended or adjusted under 35 U.S.C. 154(b) by 1069 days.

(21) Appl. No.: 11/680,627

(22) Filed: Mar. 1, 2007

(65) Prior Publication Data

US 2008/0210056 A1 Sep. 4, 2008

(51) Int. Cl.
*B24B 1/00* (2006.01)

(52) U.S. Cl. ..... 451/45; 451/224; 451/234; 451/361; 451/371; 76/82.1; 269/59

(58) Field of Classification Search ..... 451/11, 451/45, 48, 224, 229, 175, 234, 361, 365, 451/371; 76/82.1; 269/55, 59, 60
See application file for complete search history.

(56) References Cited

U.S. PATENT DOCUMENTS

| | | | | | |
|---|---|---|---|---|---|
| 3,766,806 | A * | 10/1973 | Benner | 76/42 |
| 3,885,352 | A | 5/1975 | Juranitch | |
| 4,148,158 | A * | 4/1979 | Hewitt | 451/141 |
| 4,265,146 | A | 5/1981 | Horrell | |
| 4,474,086 | A * | 10/1984 | Darr | 76/43 |
| 4,736,544 | A * | 4/1988 | Greenquist | 451/124 |
| 4,936,053 | A | 6/1990 | Shanelec | |
| 5,218,787 | A | 6/1993 | Rice | |
| 5,329,731 | A * | 7/1994 | Wall | 451/234 |
| 5,725,415 | A * | 3/1998 | Bernhard | 451/45 |
| 6,123,611 | A | 9/2000 | Lawrence, Jr. | |
| 6,471,569 | B1 | 10/2002 | Bernhard | |
| 6,761,623 | B1 * | 7/2004 | Baker | 451/280 |
| 6,908,373 | B1 * | 6/2005 | Ohman et al. | 451/278 |
| 2004/0142645 | A1 | 7/2004 | Maus, Jr. | |
| 2004/0244538 | A1 * | 12/2004 | Franzen et al. | 76/82.1 |
| 2007/0184756 | A1 * | 8/2007 | Dieck et al. | 451/11 |
| 2007/0184760 | A1 * | 8/2007 | Cotton | 451/45 |
| 2009/0124170 | A1 * | 5/2009 | Thomas | 451/11 |

* cited by examiner

*Primary Examiner* — Eileen P. Morgan
(74) *Attorney, Agent, or Firm* — John K McCormick

(57) ABSTRACT

A method and apparatus for sharpening clockwise rotating standard blades, counter-clockwise rotating standard blades and mulching style blades of either clockwise or counter-clockwise rotation is provided. The present invention comprises a base with a blade fixture which is reversible to accommodate both clockwise and counter-clockwise rotating blades. Uprights, a slide shaft, a slide bushing and a handle shaft connected to a disc grinder provide a means for setting a primary cutting angle for sharpening the primary cutting edges of a blade. An adjusting wheel rotatable attached to the handle shaft and pivotably coupled to the disc grinder provide a means for quickly and easily adjusting the cutting angle in order to accommodate sharpening the secondary cutting edges of a mulching style blade and returning the disc grinder back to its original cutting angle.

31 Claims, 14 Drawing Sheets

DEVICE AND METHOD FOR SHARPENING BLADES

BACKGROUND OF THE INVENTION

The invention relates generally to a method and apparatus for blade sharpening. More specifically, the invention provides a method and apparatus for sharpening rotary law mover blades and, in particular, sharpening both clockwise rotating and counter-clockwise rotating blades as well as sharpening both standard and mulching type lawnmower blades.

As civilization has progressed from its primeval beginnings, small groups of people formed mobile communities that worked together to hunt and gather food for themselves. As their knowledge and technology advanced, they became more settled and found ways to cultivate the earth and domesticate animals for their own use and benefit without the need to be constantly on the move. As civilizations advanced further, these groups became larger communities and even large cities for trade, commerce and other activities. These activities generated greater wealth for some individuals such that they could own their own homes and have servants to take care of many, if not all, of the domestic chores such as, but not limited to, washing clothes, cleaning the household, caring for the children, preparing and cleaning up meals and so forth. At some point in time, the exact date being unknown, wealthy home owners decided to hire servants to tend the household yards in order to make more enjoyable use of the property they owned. One of the tasks required to tend the yards was to keep the lawn mowed in a neat and pleasing appearance. At that time, the process for mowing the lawns consisted of hiring a group of servants with hand sickles to cut the lawn by hand. As would be apparent to anyone considering this activity, it was a constant and laborious task to accomplish.

With more advances in technology came manual hand powered lawnmowers and later gasoline powered lawnmowers. It is only in recent history that riding lawnmowers have become available for property owners personal use. While these obvious advances are plain for most individuals to see and appreciate, there have been many more advances that most people are unaware of or take no notice of. These advances include such things as a better means for leveling a power lawnmower desk so as to provide a more even appearance to a cut lawn. Wide, low air pressure filled tires allow a lawn tractor to traverse over most ground surfaces without leaving tire marks in the ground or grass. A better understanding of how to properly cut grass led to a better understanding of the proper blade cutting edge and angle that a lawnmower blade should have. A further advancement was the development of an automatic means for collecting the grass clippings and debris as the lawn was being mowed, typically known as a bagger. This allowed for easy disposal of the clippings and debris and greatly reduced the time for yard maintenance.

As an alternative to collecting the grass clippings and disposing of them, came the development of what is known in the art as mulching lawnmower blades. Mulching lawnmower blades cut the grass into much smaller pieces which, when left back on the ground, decompose quickly and leave their nutrients back into the soil to aid in the growth of new grass. A standard, or non-mulching, clockwise rotating lawnmower blade 1, as shown in FIG. 1, has two (2) primary cutting edges 2 and 3 that are on the same horizontal plane. There is a mounting hole 4 at the center of the blade 1 for mounting the lawn mower blade 1 to a driven shaft (not shown). A mulching clockwise rotating lawnmower blade 6, as shown in FIG. 2, has four (4) cutting edges along with a mounting hole 4. The lower two cutting edges are the primary cutting edges 2 and 3 and lie on a first horizontal plane. The top two cutting edges are secondary cutting edges 7 and 8 and lie on a second horizontal plane above the first horizontal plane. Both the standard clockwise rotating blade 1 and the mulching type clockwise rotating blade 6 have upturned ends 5 of the non-cutting primary edges which causes the cut grass to be lifted upwards above the blade 1 or 6. With a mulching type lawnmower blade 6, as the grass is cut for a first time with the primary cutting edges 2 and 3, the portion of grass that was cut off is lifted by air pressure created by the rotating mulching lawnmower blade 6 and the upturned ends 5 such that the cut off portion of grass encounters the secondary cutting edges 7 and 8 which further cuts the grass portion into finer bits of grass for quicker decomposition.

For many people, the use of mulching type lawnmower blades 6 is a preferable alternative as there is no need to spend time and effort to collect and then dispose of the grass clippings and it has the further advantage of returning the nutrients back into the soil for further plant growth.

In addition to the standard clockwise rotating lawnmower blade 1 and the mulching type clockwise rotating lawnmower blade 6, there are also two categories that define the type of lawnmower blade that is utilized in lawnmowers. These are the clockwise rotating lawnmower blades 1 or 6 and the counter-clockwise rotating lawnmower blades 9, of which only the standard blade 9 is shown in FIG. 3. FIG. 1 depicts a standard clockwise rotating lawnmower blade 1 and FIG. 3 depicts a counter-clockwise rotating lawnmower blade 9. The primary difference between a clockwise rotating lawnmower blade 1 or 6 and a counter-clockwise rotating blade 9 is that the cutting edges 2 and 3 of a counter-clockwise rotating blade 9 are on the opposites sides of a clockwise rotating blade 1 or 6 as are the upturned ends 5. Counter-clockwise rotating mulching blades are also available similar to the mulching style blade 6 depicted in FIG. 2 but with the secondary cutting edges 7 and 8 on the opposite sides when compared to a clockwise rotating mulching blade 6.

Cutting grass is a very abrasive process. If a user starts with a lawnmower blade, sharpened properly and at the correct cutting angle, as they mow the lawn, the process of cutting grass quickly dulls the sharp cutting edges of the blade. As the cutting edges of the blade becomes duller and duller, instead of cutting the grass the blade starts to tear the grass. This not only leads to an unappealing lawn surface, but can damage the grass thereby increasing the grass' susceptibility to disease.

Consequently, there is a need to sharpen the lawnmower blade or blades on a regular basis. Professional lawn care providers often sharpen their lawnmower blades after every day's use. The same is often true for those individuals responsible for the care of lawns at golf courses and recreational areas such as playgrounds and parks. Individual home owners sharpen their lawnmower blades at their own discretion.

In re-sharpening a lawnmower blade, great care must be taken in a variety of areas. First and foremost is the need for safety. Regardless of the method of sharpening used, care should be taken to securely clamp or hold the lawnmower blade in place so that it does not come loose and injure someone or something. Secondly, if some form of powered sharpening mechanism is utilized, such as bench or disc grinders, there should be a means to trap and arrest any hot sparks resulting from the sharpening process in order to prevent burns or fires. Thirdly, it is important to retain the original angle of the cutting edges of both the primary, 2 and 3, and secondary, 7 and 8, cutting edges in order to maintain the proper grass cutting action. Fourth, when sharpening a lawnmower blade, it is important to maintain the balance of the blade. This means that in re-sharpening a lawnmower blade, all of the cutting edges on a given plane should have the same amount of material removed from them. If not, the high rotary speed of the blade in use can cause the grass to be cut unevenly leading to an unaesthetic appearance. Other areas where care is needed are well known in the art.

The means for re-sharpening a lawnmower blade are varied and numerous. In one method, a user clamps a lawnmower blade in a vice and utilizes a metal file to hand sharpen the blade. However, this can lead to erroneous and uneven cutting edge angles and cause the blade to become out of balance.

U.S. Pat. Pub. 2004/0142645 published on Jul. 22, 2004 to Harold Maus discloses a rotary lawnmower blade sharpener that can be utilized with a bench grinder to sharpen the primary cutting edges of a lawnmower blade. This sharpening device being distinguishable from the present invention in that there is no means provided for sharpening the secondary cutting surfaces of a mulching type blade as the fixture clamps the lawnmower blade about the center where the secondary cutting edges are located and does not allow the center of a mulching type blade to come in contact with the grinding wheel. In addition, the apparatus, as best understood and described, is only suitable for sharpening either clockwise rotating blades or counter-clockwise rotating blades but not both with the same apparatus.

U.S. Pat. Pub. 2004/0244538 published on Dec. 9, 2004 to Johannes Franzen, et al. discloses an apparatus for sharpening multiple blade knives. This sharpening device being distinguishable from the present invention in that there is no means provided for sharpening the secondary cutting surfaces of a mulching type blade as the fixture clamps the lawnmower blade about the center where the secondary cutting edges are located and does not allow the center of a mulching type blade to come in contact with the grinding wheel. In addition, the apparatus, as best understood and described, is only suitable for sharpening either clockwise rotating blades or counter-clockwise rotating blades, depending upon the relative position of the fixture to the grinding medium, but not both with the same apparatus.

U.S. Pat. No. 4,736,544 issued on Apr. 12, 1988 to Lawrence Greenquist discloses a blade holder for sharpening lawnmower blades. This sharpening device being distinguishable from the present invention in that there is no means provided for sharpening the secondary cutting surfaces of a mulching type blade as the fixture clamps the lawnmower blade about the center where the secondary cutting edges are located and does not allow the center of a mulching type blade to come in contact with the grinding wheel. As shown and described, the apparatus depicts the holder as being utilized to sharpen counter-clockwise rotating blades. In order to utilize the device to sharpen clockwise rotating blades, either the fixture or the grinding wheel must be physically removed and repositioned to the reverse side of the work bench which is a laborious and time consuming process.

U.S. Pat. No. 6,761,623 issued on Jul. 13, 2004 to Wayne Baker discloses an apparatus and method for sharpening blades at a predetermined angle. As disclosed, the blade is mounted on a clamping fixture above a disc grinder, the disc grinder being pivotally mounted at its base. This sharpening device, as best understood by the specifications and drawings, being distinguishable from the present invention in that there is no means provided for sharpening the secondary cutting surfaces of a mulching type blade. In addition, the apparatus is only suitable for sharpening either clockwise rotating blades or counter-clockwise rotating blades, depending upon the relative position of the fixture to the grinding medium, but not both with the same apparatus.

It is, therefore, an object of this invention to provide an apparatus and a method for sharpening both standard and mulching style lawnmower blades to the proper cutting edge angle.

It is a further object of this invention to provide an efficient and easy apparatus and method for sharpening both clockwise rotating lawnmower blades and counter-clockwise rotating lawnmower blades.

It is still a further object of this invention to assure the safety of the user and area by trapping and arresting any sparks generated during the process of re-sharpening a lawnmower blade for easy disposal later.

It is still a further object of this invention to make the process of loading, sharpening all cutting edges and unloading a quick, simple and accurate process for the user.

Other features and advantages of this disclosure will become apparent to one skilled in the art upon examination of the following drawings and detailed description. It is intended that all such additional features and advantages be included within the scope of the present invention.

SUMMARY OF THE INVENTION

The present invention recognizes and addresses the various drawbacks and limitations of the various apparatuses for the sharpening of lawnmower blades of both the clockwise rotating lawnmower blade type and the counter-clockwise rotating lawnmower blade type as well as sharpening both standard type lawnmower blades and mulching type lawnmower blades. Additional objects and features of the invention are set forth in, or will be apparent to those of ordinary skill in the art, from the detailed description that follows. It should be further appreciated that modifications and variations to the specifically illustrated and disclosed features and materials hereof may be practiced in various embodiments and uses of this invention without departing from the spirit and scope thereof. Such variations may include, but are not limited to, substitutions of the equivalent means, features, and materials for those shown or discussed and the functional, or positional reversal of various parts, features or the like.

These and other features, aspects and advantages of the present invention will become better understood with reference to the following description and appended claims. The accompanying drawings, which are incorporated in and constitute a part of this specification, illustrate an embodiment of the invention and together with the description serve to explain the principles of the invention.

In one exemplary embodiment, there is provided an apparatus and method for sharpening both clockwise rotating blades and counter-clockwise rotating blades at the proper angle comprising a base with a blade fixture that is easily and quickly reversible depending upon the type of blade being sharpened. By positioning the blade fixture in a first position on the base the apparatus is ready for sharpening clockwise rotating blades. By repositioning the blade fixture in a second position on the base the apparatus is ready to sharpen counter-clockwise rotating blades.

Simultaneously, there is provided an apparatus and method for quickly and easily sharpening a primary cutting edge of a blade and then quickly and easily changing the angle of sharpening such that a secondary cutting edge of a mulching style blade can be properly sharpened to a proper cutting angle for the secondary cutting edge. This comprises an adjusting wheel, a spring loaded ball detent and an offset pivotable coupling tied to both the handle shaft and the sharpening mechanism. By turning the adjusting wheel, the pivotable offset coupling changes the angle of the sharpening mechanism which allows a user to easily adjust grinding angles between the primary cutting edge and the secondary cutting edge which are typically about one inch difference in height.

BRIEF DESCRIPTION OF THE DRAWINGS

A system and a method according to the invention will be described in more detail by with reference to the appended drawings in which.

DETAILED DESCRIPTION OF THE PREFERRED EMBODIMENT

Figure 1:
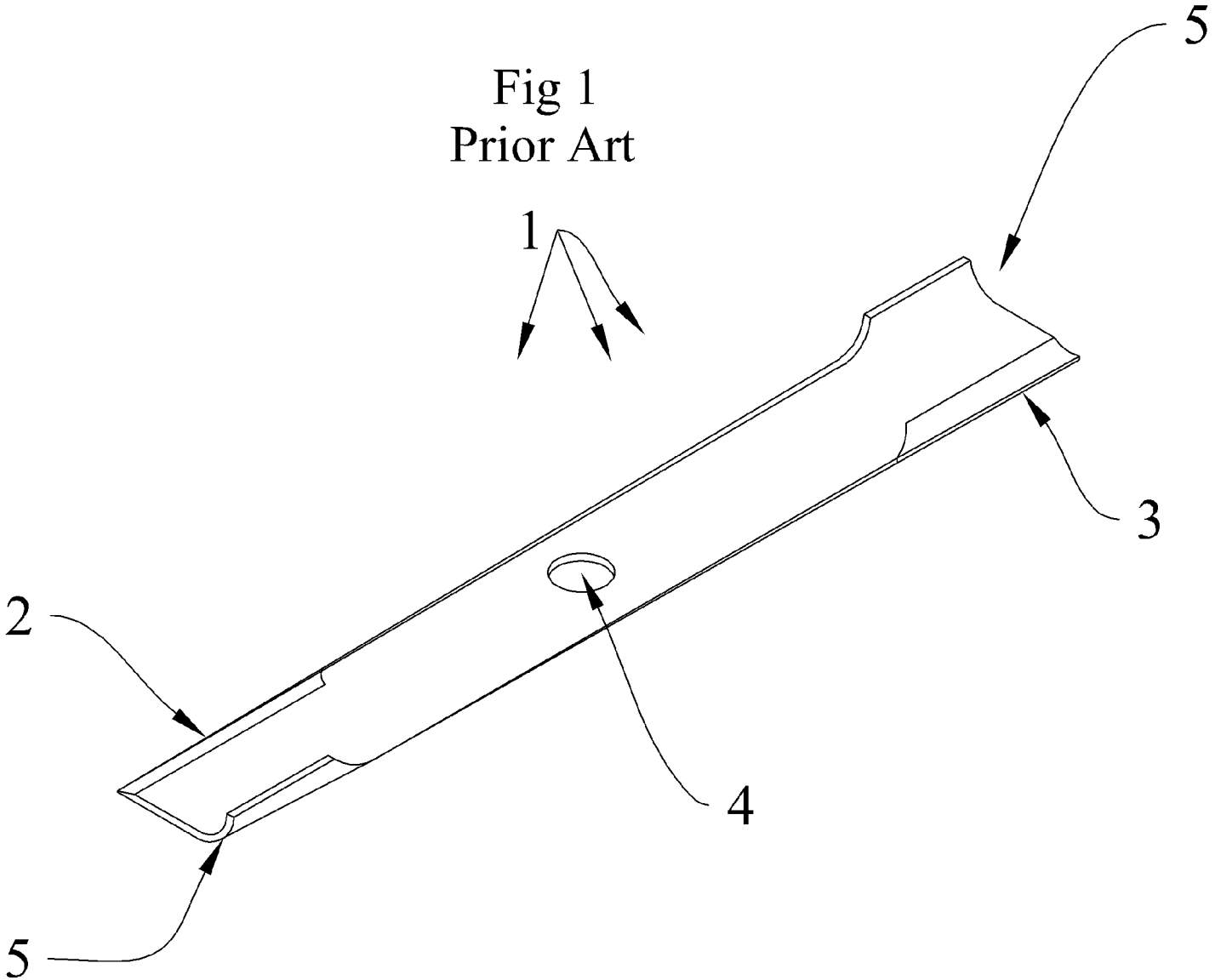
Fig 1 Prior Art
FIG. 1 is a perspective view of a prior art clockwise rotating standard lawnmower blade.

Reference will now be made in detail to the description of the invention as illustrated in the drawings. Although the invention is described in connection with the drawings, there is no intent to limit the invention to the embodiment or embodiments disclosed therein. On the contrary, the intent is to include all alternatives, modifications, and equivalents included within the scope and spirit of the invention as defined by the appended claims.

Figure 4:
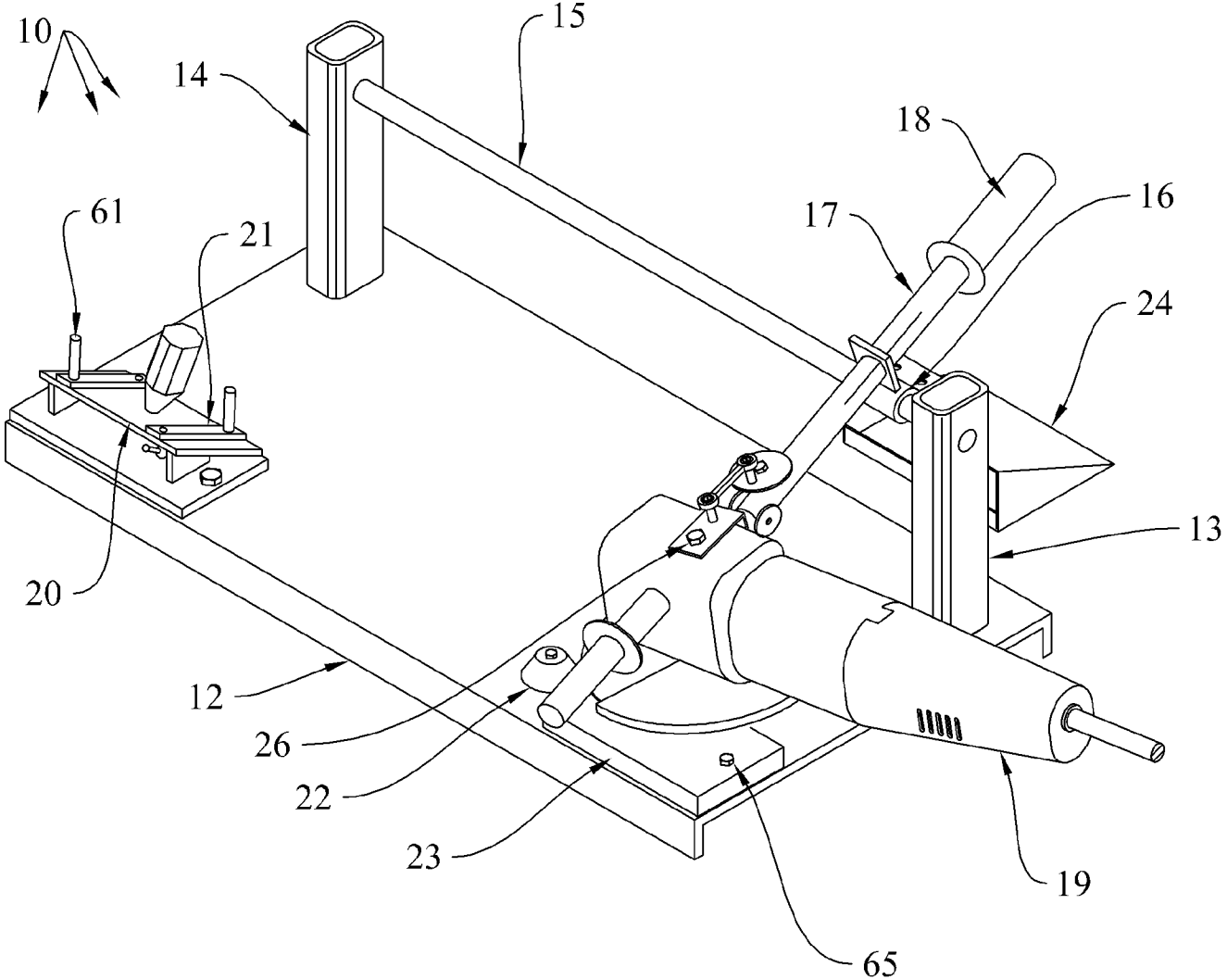
FIG. 4 is a perspective view of a first embodiment of the present invention.

The present invention 10 is primarily concerned with a method and apparatus for sharpening lawnmower blades, and in particular, the sharpening of both clockwise and counter-clockwise rotating blades and with both standard type blades and mulching type blades. As depicted in FIG. 4, there is a base plate 12. Removably mounted to the base plate 12 is a blade fixturing means 20 with two adjustable blade stop assemblies 21, a blade fixture adaptor 22 and a sharpening mechanism rest 23. The rest 23 preferably being made out of a resilient material such as nylon, polyurethane or the like to prevent damage to the base plate 12 and/or the sharpening mechanism 19. Fixedly mounted to the base plate 12 are two uprights 13 and 14. Mounted between the upper ends of the uprights 13 and 14 is a slide shaft 15. Slideably and rotatably mounted to the slide shaft 15 is a slide bushing 16. Perpendicularly attached to the top of the slide bushing 16 is a handle shaft 17 and on the underside of the slide bushing 16 is a removably mounted spark trap 24. At a first end of the handle shaft 17 is attached a cushioned handle grip 18 and at a second end of the handle shaft 17 is mounted a sharpening mechanism 19. The specific details of the means for mounting the sharpening mechanism 19 to the handle shaft 17 is discussed in greater detail below.

Figure 5:
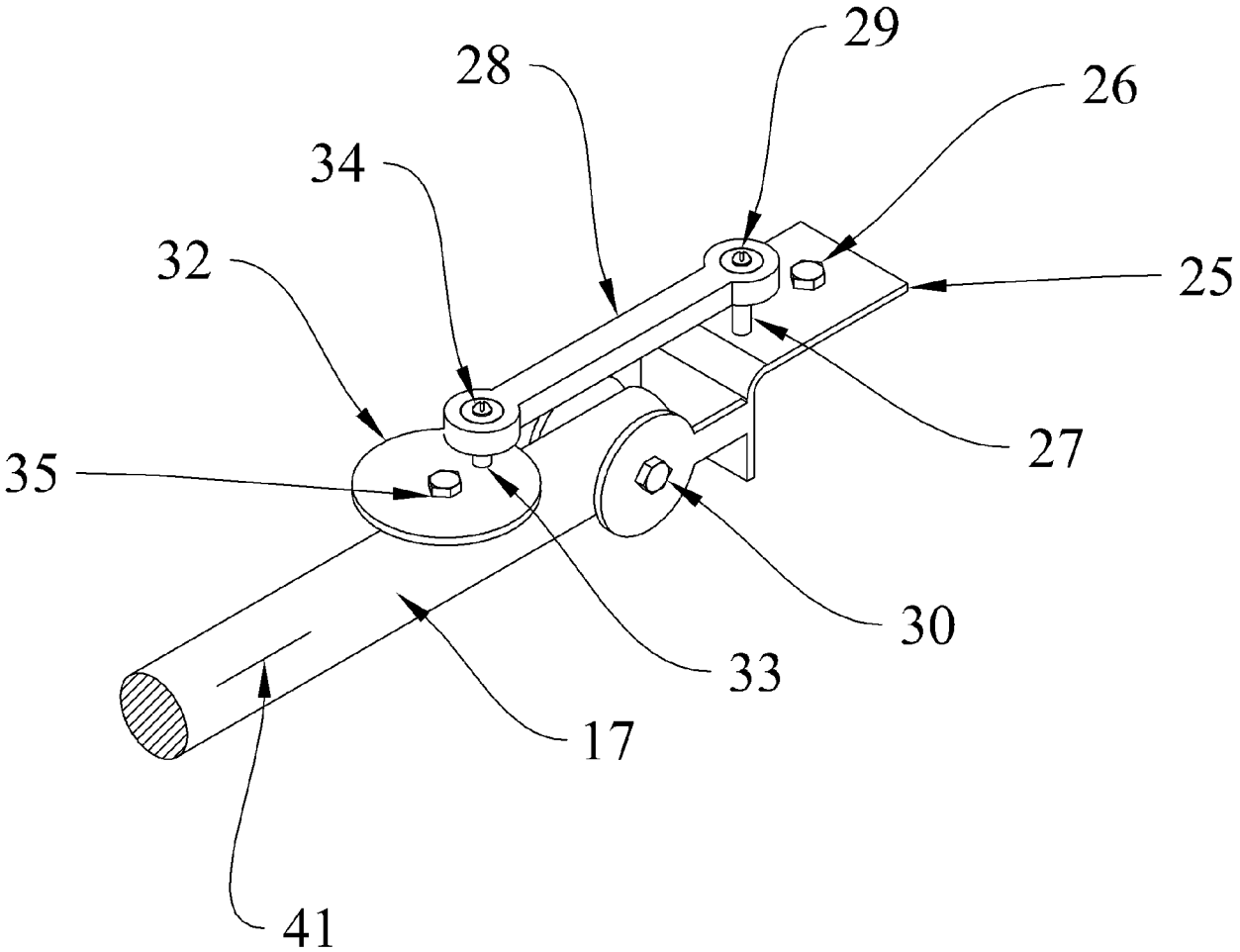
FIG. 5 is a perspective view of the mechanism for adjusting the angle of the sharpening mechanism of the present invention.
Figure 6:
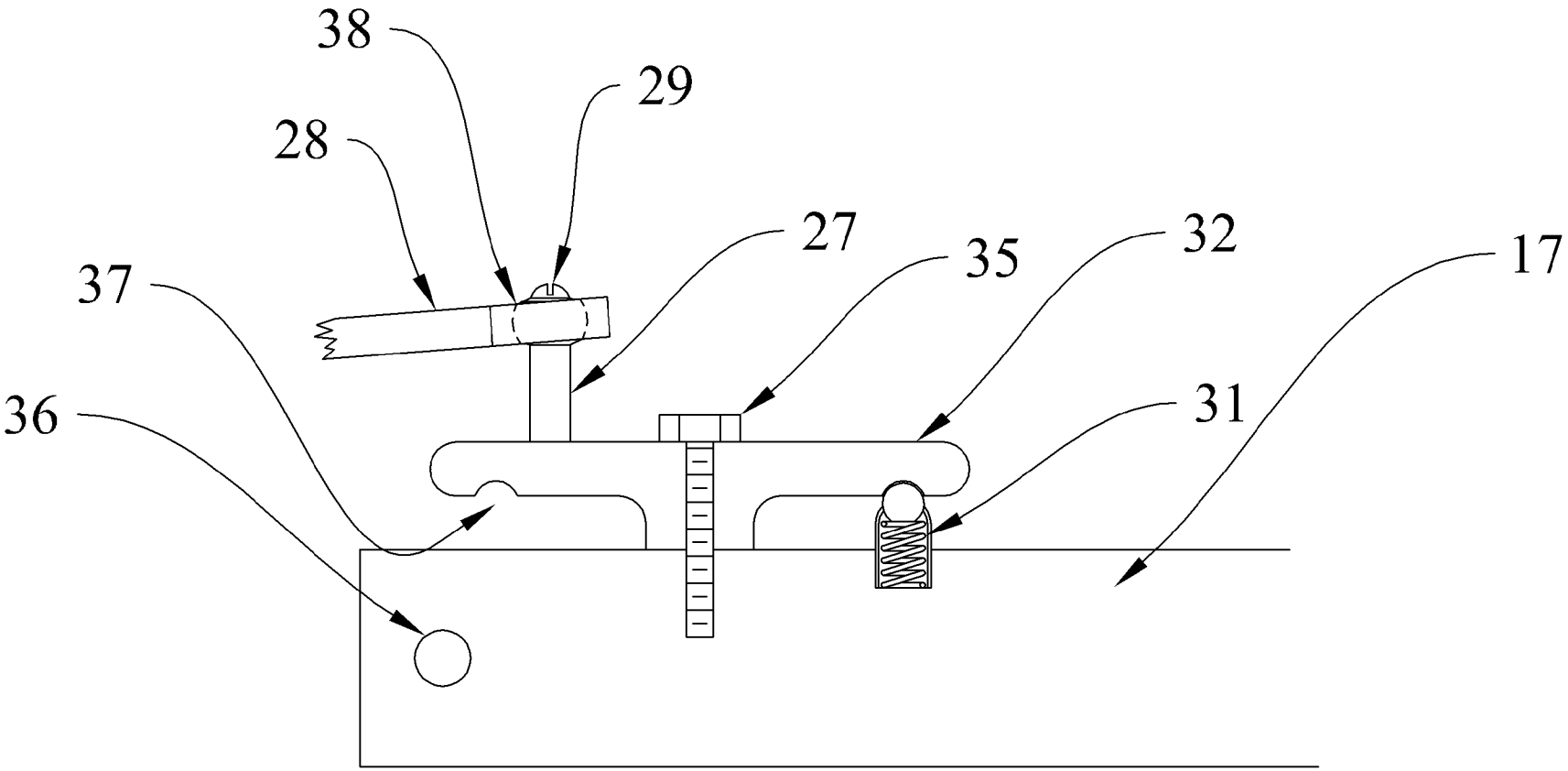
FIG. 6 is a cross sectional planar view of the adjusting wheel of the present invention.

FIG. 5 discloses the preferred embodiment for attaching the handle shaft 17 to the sharpening mechanism 19. There is an angled bracket 25 through which a bolt 26 passes and is attached to the sharpening mechanism 19 (shown in FIG. 4). On the top surface of the angled bracket 25 is a first post 27 to which is attached a first end of a pivotable coupling 28 by a screw 29. The handle shaft 17 is connected to the base of the angled bracket 25 by a bolt 30 and nut (not shown). On the top side of the handle shaft 17 is mounted a spring loaded detent ball 31 shown in FIG. 6. Rotatably mounted to the handle shaft 17 by a bolt 35 is an adjusting wheel 32 which is in selective contact with the spring loaded detent ball 31 as shown in FIG. 6. On the top of the adjusting wheel 32 is an offset second post 33 to which is attached the second end of the pivotable coupling 28 by a screw 34. There is also a scribe line 41 on the handle shaft 17 which is utilized in setting the primary cutting angle of the sharpening mechanism 19 (shown in FIG. 4) as will be described later.

FIG. 6 is a cross-sectional view of the handle shaft 17, adjusting wheel 32, spring loaded detent ball 31 and a portion of the pivotal coupling 28. The adjusting wheel 32 rotates about the bolt 35 selectively engaging the spring loaded ball detent 31 on the underside of the adjusting wheel 32 in the pockets 37. The pivotal coupling 28 pivots about the pivot ball 38. The hole 36 in the handle shaft 17 is utilized to attach the handle shaft 17 to the angle bracket 25 (shown in FIG. 5).

Figure 7:
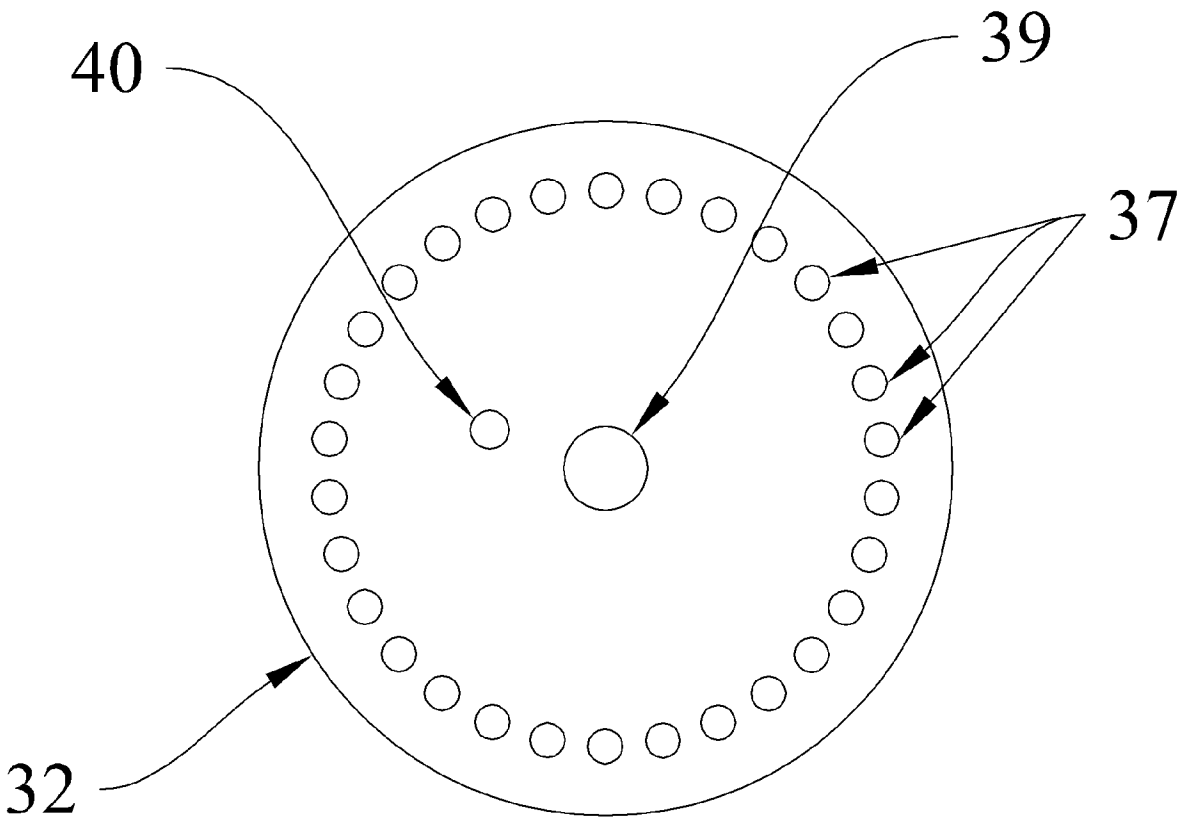
FIG. 7 is a bottom planar view of the adjusting wheel.

FIG. 7 depicts the underside of the adjusting wheel 32 which has a pivot hole 39 for mounting the adjusting wheel 32 to the handle shaft 17 (shown in FIG. 5), an offset hole 40 used to mount the second offset post 33 and a plurality of recessed pockets 37 for accepting the spring loaded detent ball 31 (shown in FIG. 6).

Figure 8:
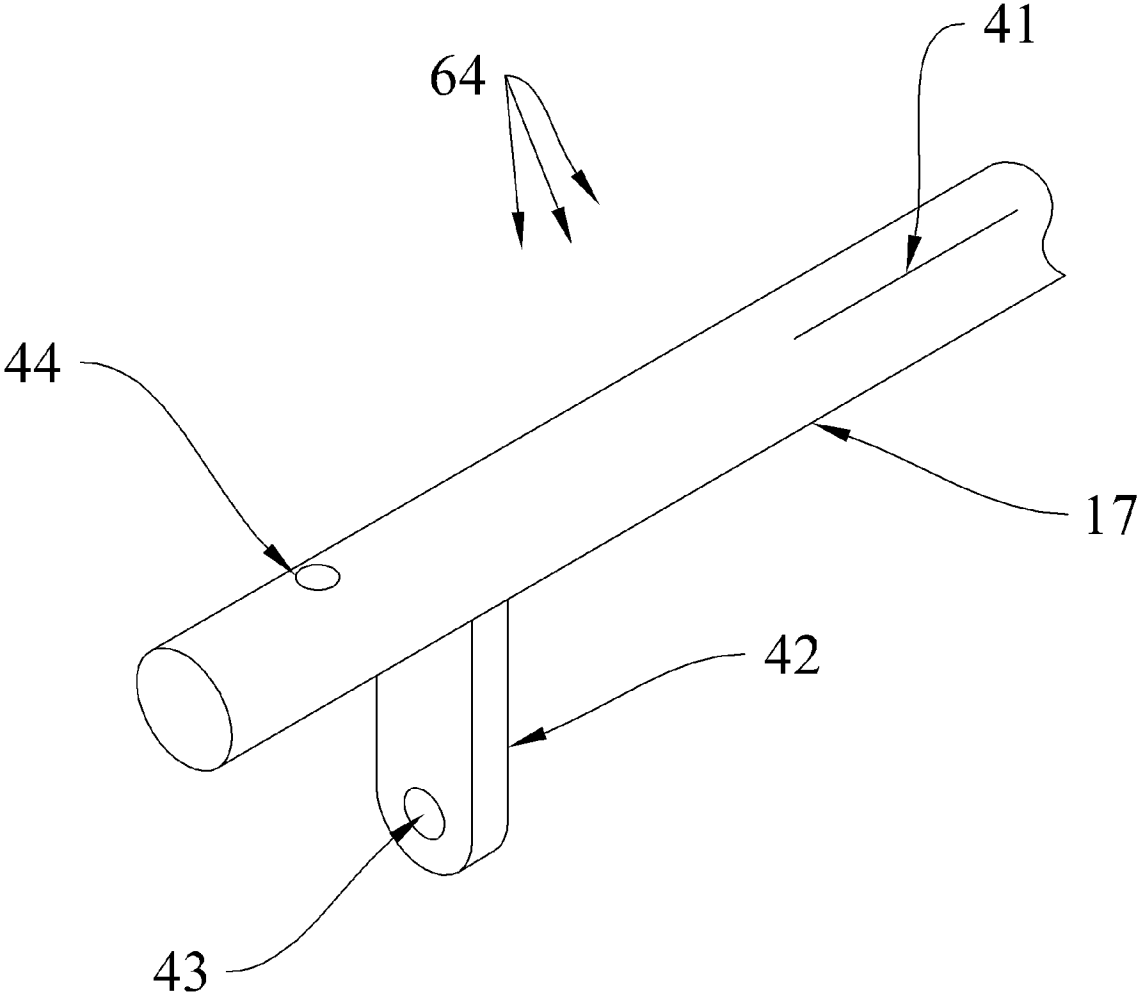
FIG. 8 is an alternate embodiment of the handle shaft of the present invention.

FIG. 8 depicts an alternate embodiment 64 for attaching the handle shaft 17 to the sharpening mechanism 19 (shown in FIG. 4). In this embodiment there is a bracket 42 fixedly attached to the handle shaft 17. The bracket 42 has a mounting hole 43 for a bolt to attach the bracket 42 to the sharpening mechanism 19 (shown in FIG. 4). There is a through-hole 44 in the end of the handle shaft 17 for bolting the handle shaft 17 to the sharpening mechanism 19 (shown in FIG. 4). There is a scribe line 41 on the handle shaft 17 which is utilized in setting the primary cutting angle of the sharpening mechanism 19 (shown in FIG. 4) as will be described later.

Figure 9:
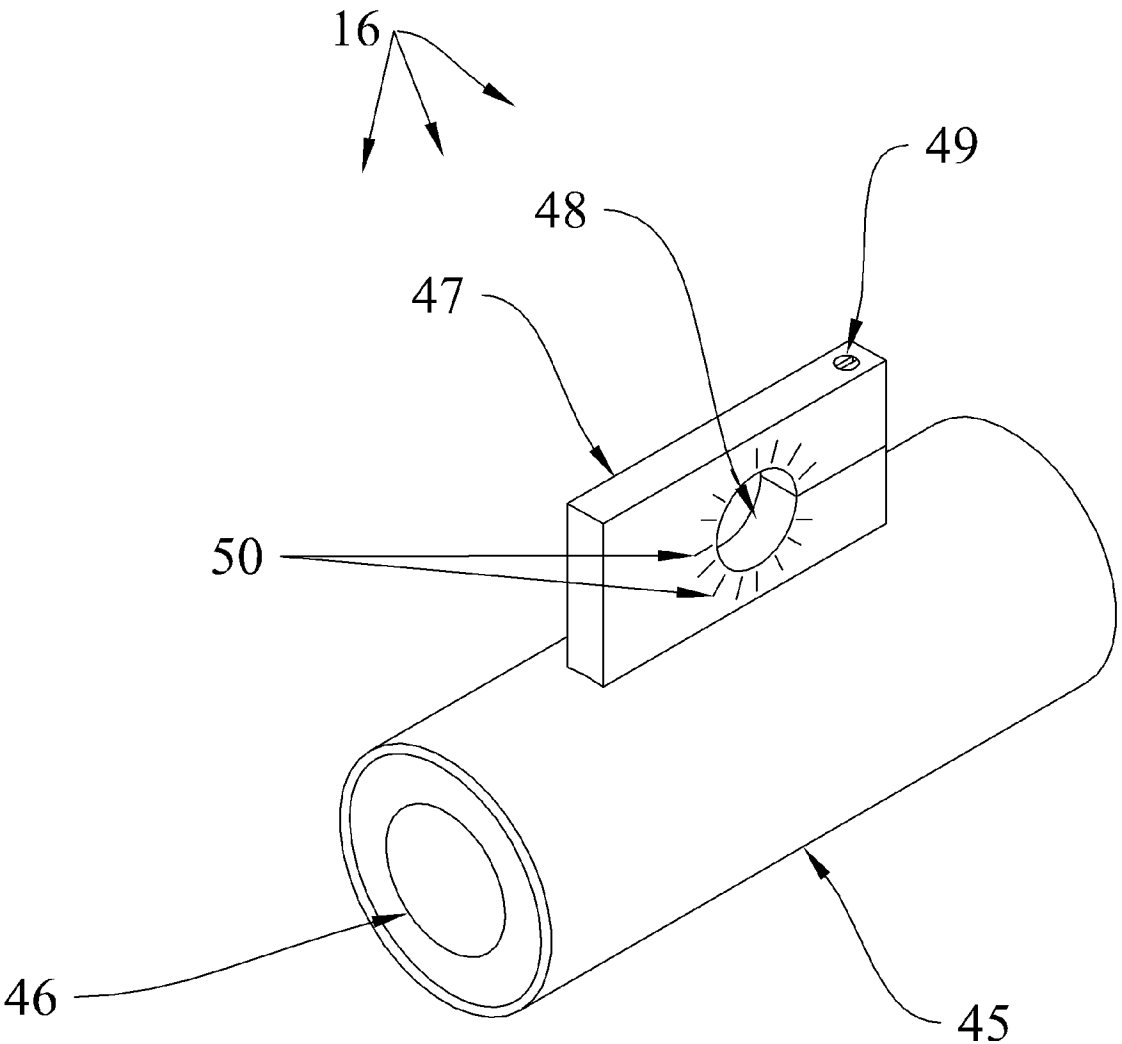
FIG. 9 is a perspective view of the slide bushing of the present invention.

FIG. 9 depicts the slide bushing 16 which comprises a metal housing 45, spark and heat resistant bushing slide 46 and a split bar clamp 47. The split bar clamp 47 has a through-hole 48 for accepting the handle shaft 17 (shown in FIG. 4) and a locking screw 49 for tightening down the split bar clamp 47 in order to clamp the handle shaft 17 (shown in FIG. 4) in place. There is a plurality of line markings 50 on the face of the split bar clamp 47 around the outside edge of the through-hole 48. The reference line 41, shown in FIGS. 5 and 8, that is scribed on the handle shaft 17 (shown in FIGS. 5 and 8) is used in aligning the angle of the sharpening mechanism 19 (shown in FIG. 4) with the line markings 50 on the split bar clamp 47. By rotating the handle shaft 17 (shown in FIG. 4) in the split bar clamp 47, the angle that the sharpening mechanism 19 (shown in FIG. 4), in relationship to a lawnmower blade, can be determined by referring to the reference line 41 in the handle shaft 17 (shown in FIG. 4) to the line markings 50 on the split bar clamp 47. In this way, fine adjustments can be made to the resulting cutting angle of the lawnmower blade cutting edges.

Figure 10:
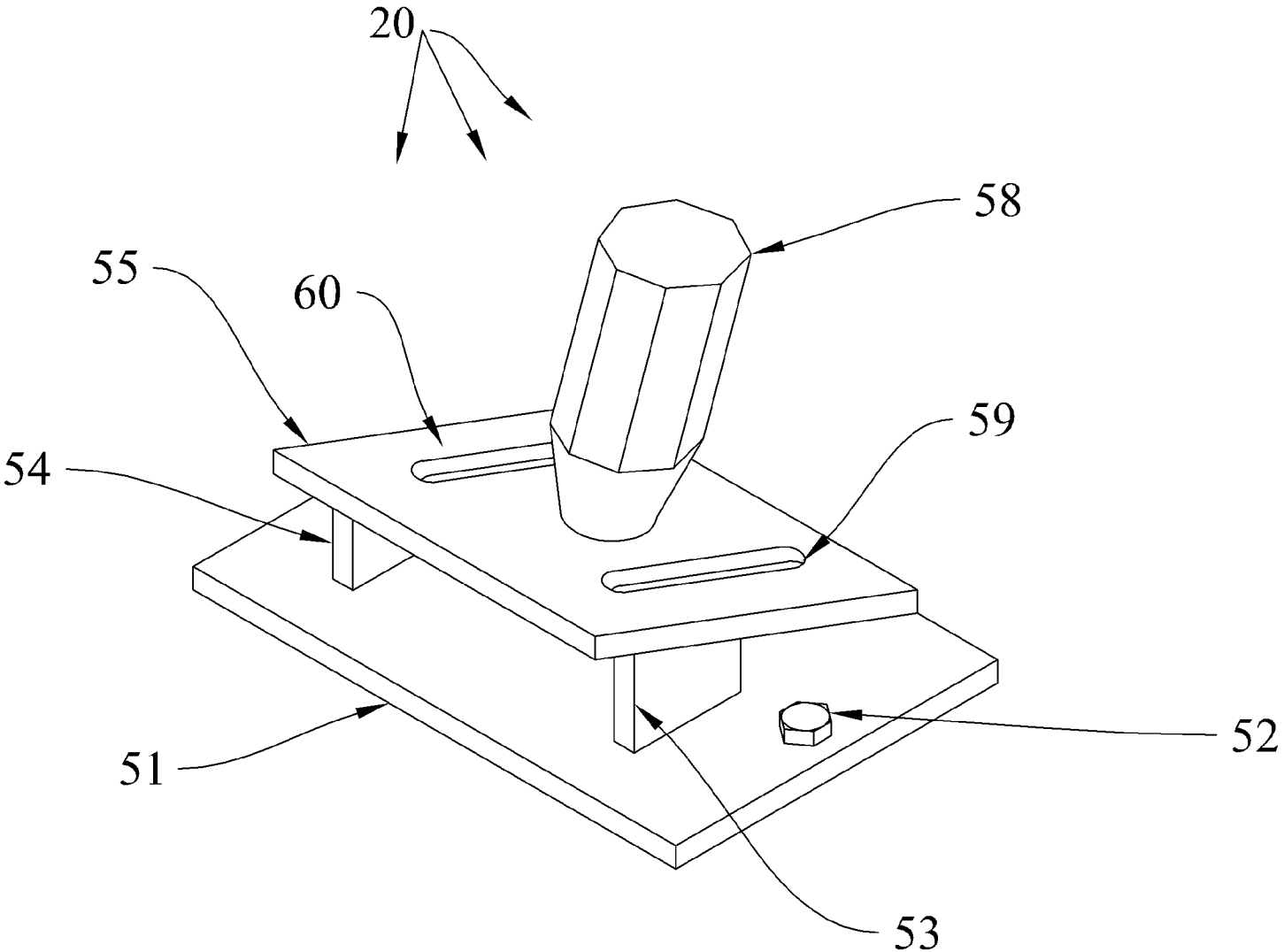
FIG. 10 is a perspective view of the blade fixture assembly of the present invention.

FIG. 10 depicts a perspective view of the blade fixture 20. The blade fixture 20 comprises a fixture base plate 51 which has two mounting bolts 52 (only one is shown). Attached to the base plate are two uprights 53 and 54. Attached to the uprights is an angled fixture plate 55 which has two slots 59 and 60 and a threaded hole (not shown). There are two slideable blade stop assemblies 21 (shown in FIG. 11), each of which has a bar 56, a blade stop 61, an underside guide pin 75 that is inserted into the slot 59 or 60, a clamping pin 76 to which is movably attached an offset cam with a lever 77. Inserted into the threaded hole is the tapered lawnmower blade clamp 58. Other means of clamping are well known in the art.

Figure 11:
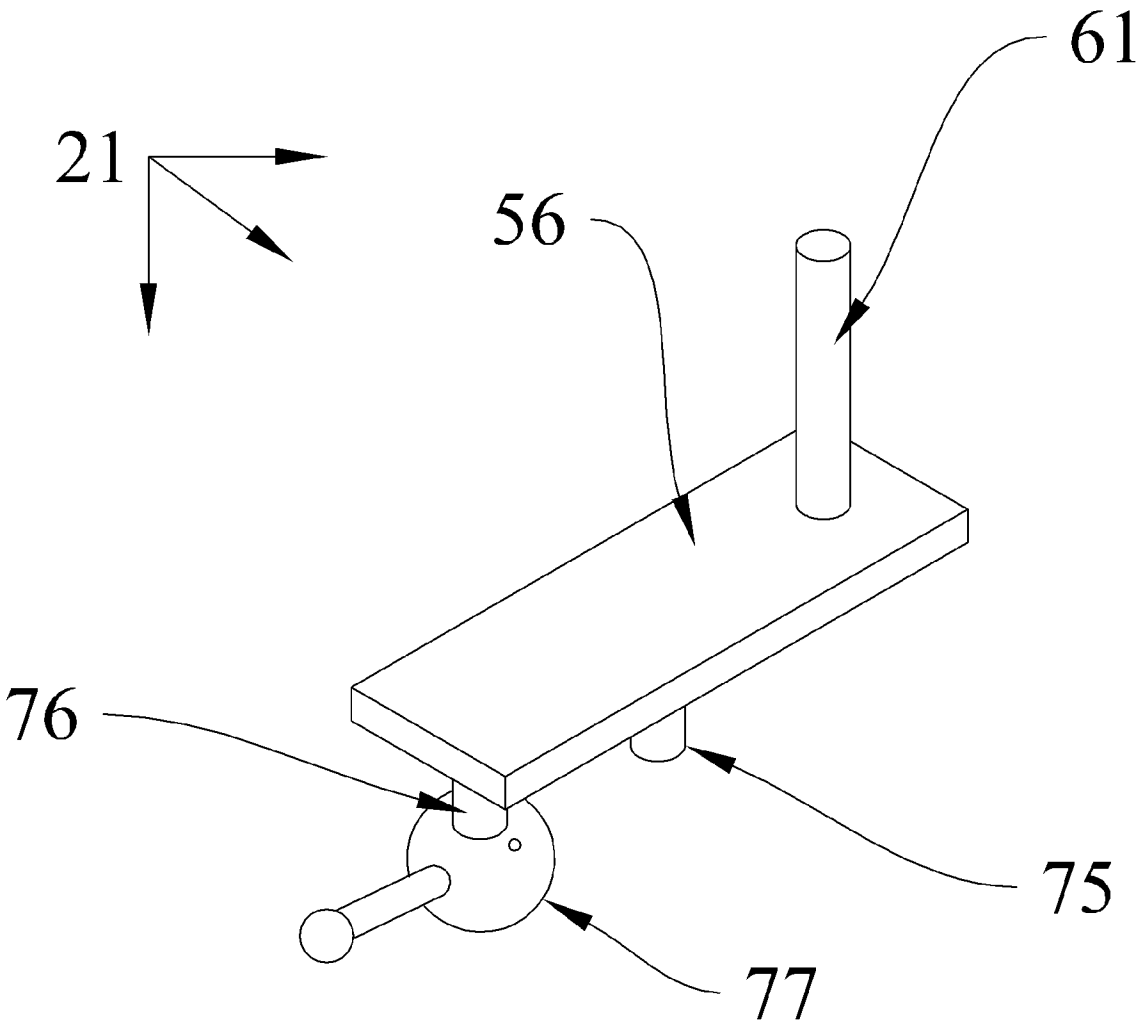
FIG. 11 is a perspective view of the blade stop assembly of the present invention.

FIG. 11 depicts one of the adjustable blade stop assemblies 21. In use, each of the adjustable blade stop assemblies 21 is slideably attached to the fixture plate 55 with the guide pin 75 slideably inserted into the slot 59 or 60 on the fixture plate 55. A lawnmower blade 1, 6 or 9 is then placed on the blade stop assemblies 21 and the blade clamp 58 is loosely secured to the fixture plate 55. The blade stop assemblies 21 are then slid into the proper position such that the blade stop pins 61 abut the back edge of the lawnmower blade 1, 6 or 9. The offset cams 77 are then rotated in order to secure the blade stop assemblies 21 to the fixture plate 55. The blade clamp 58 is then tightened to secure the lawnmower blade 1, 6 or 9 to the blade fixture 20.

Figure 12:
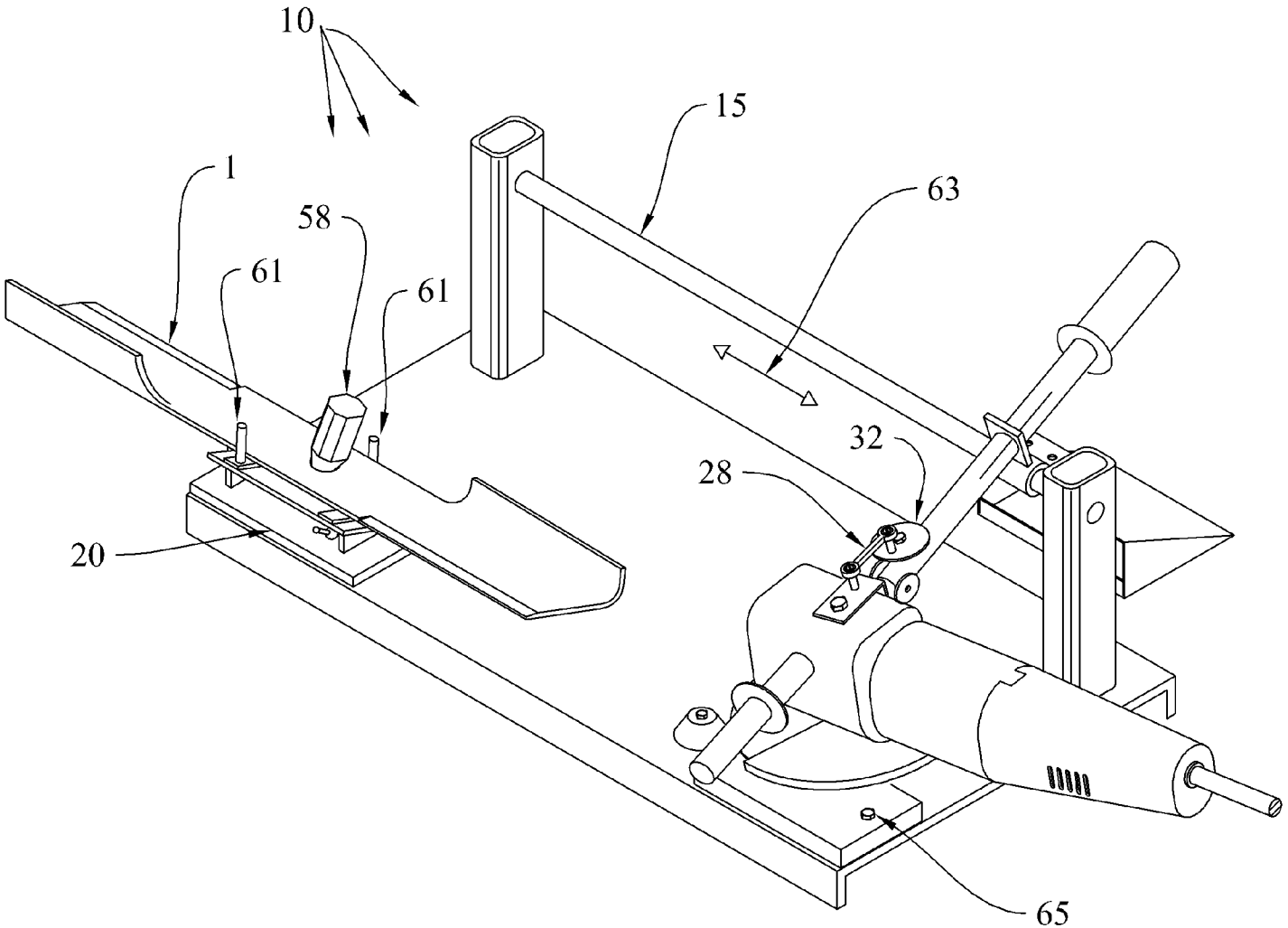
FIG. 12 is a perspective view of the present invention with a clockwise rotating standard blade mounted into the blade fixture.

FIG. 12 depicts a perspective view of the apparatus 10 with a standard clockwise cutting lawnmower blade 1 clamped into the blade fixture 20 by the blade clamp 58 with the blade stop pin 61 abutting the blade 1. The arrow 63 depicts the relative available movement of the sharpening mechanism 19 along the slide shaft 15.

Figure 13:
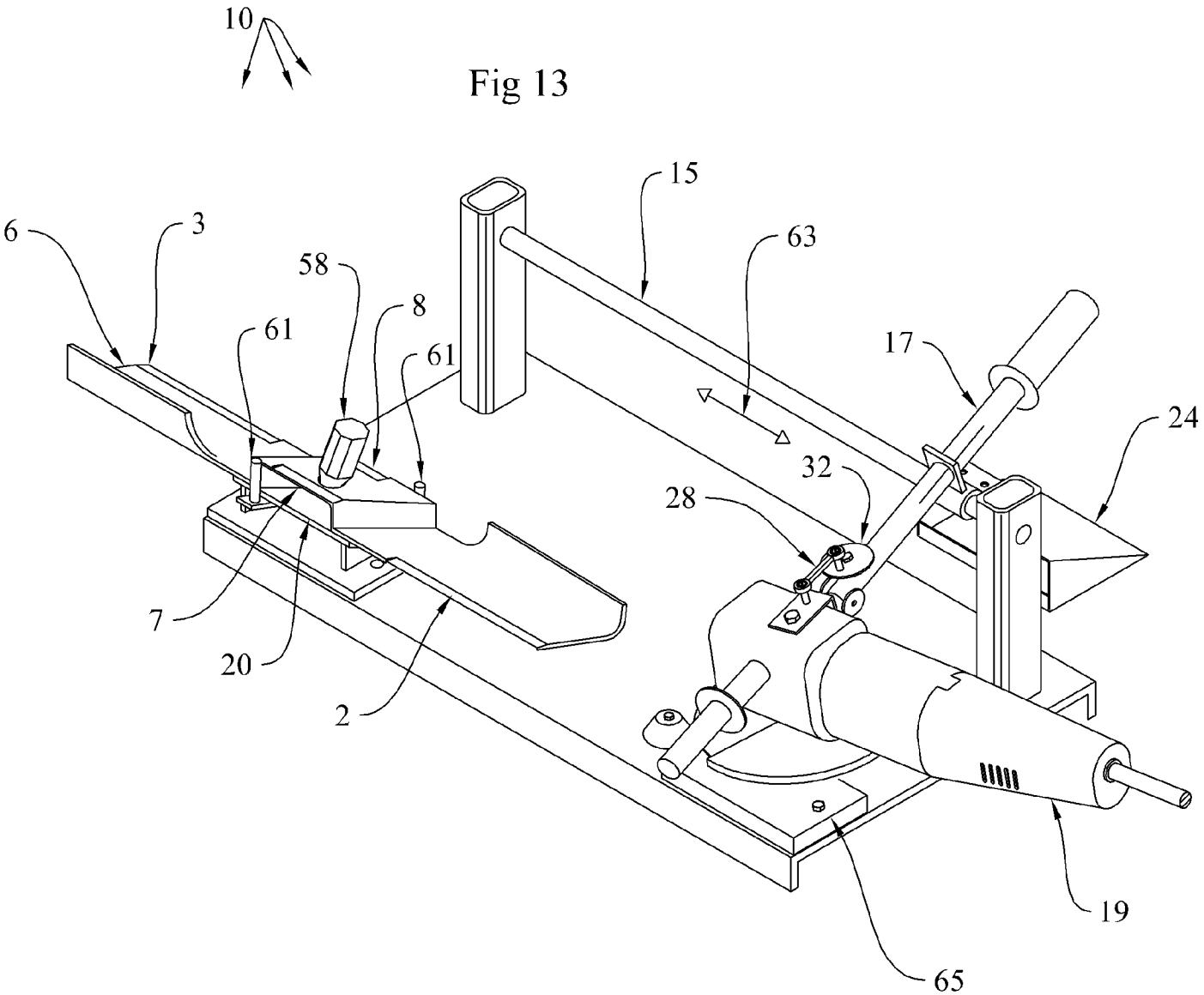
FIG. 13 is a perspective view of the present invention with a clockwise rotating mulching blade mounted into the blade fixture.

FIG. 13 depicts the apparatus 10 with a clockwise rotating mulching type lawnmower blade 6 installed on the blade fixture 20. To sharpen a clockwise rotating mulching lawnmower blade 6 with the apparatus 10, a user removes the blade clamp 58, places the blade 6 horizontally on the blade stop assemblies 21 (as shown in FIG. 10) and loosely secures the blade clamp 58 onto the blade fixture 20. The user then slides the blade stop assemblies 21 to abut the blade stop pins 61 to the lawnmower blade 6 and then secures the blade stop assembly 21 by rotating the offset cam 77. The user then tightens down the blade clamp 58. If not already preset, the user then loosens the locking screw 49 in the slit bar clamp 47 (as shown in FIG. 9), rotates the handle shaft 17 which rotates the attached sharpening mechanism 19 until the sharpening mechanism 19 is parallel with the primary cutting edge 2 or 3 and retightens the locking screw 49 to keep the handle shaft 17 and sharpening mechanism 19 in the proper position for sharpening the primary lawnmower blade cutting edge 2 or 3. Once the proper cutting angle is set for either cutting edge 2 or 3, the user can sharpen the primary blade cutting edge 2 or 3 by powering up the sharpening mechanism 19 and moving the sharpening mechanism 19 across the primary cutting edge 2 or 3 as indicated by the arrow 63.

If the user makes no adjustments to the cutting angle of the sharpening mechanism 19, attempting to sharpen the secondary cutting edges 7 or 8 of the mulching type lawnmower blade 6 will result in an improper angle of the secondary cutting edges 7 or 8 as the secondary cutting edges 7 and 8 are approximately one inch above the plane of the primary cutting edges 2 and 3 thereby changing the angular relationship of the sharpening mechanism 19 to the secondary cutting edge 7 or 8. In its preferred embodiment, to adjust the angle of the sharpening mechanism 19 quickly and easily, in order to sharpen the secondary cutting edges 7 and 8 of a mulching type lawnmower blade 6, a user turns the adjusting wheel 32 which in turn causes the offset pivotal coupling 28 to push outward or pull backward, depending upon the direction the adjusting wheel 32 is turned, which causes the sharpening mechanism 19 to re-angle itself relative to the lawnmower blade 6. Once the sharpening mechanism 19 is set at the correct angle for the secondary cutting edge 7 or 8, the user then powers up the sharpening mechanism 19 and moves the sharpening mechanism 19 along the direction indicated by the arrow 63 to sharpen the secondary cutting edge 7 or 8.

The user then removes the blade clamp 58, rotates the lawnmower blade 6 180 degrees, repositions the lawnmower blade 6 parallel to the blade fixture 20 and abutting the blade stop 61 and re-attaches the blade clamp 58. The user can then power up the sharpening mechanism 19 to sharpen the other secondary cutting edge 7 or 8, turn the adjusting wheel 32 back to its original position and re-sharpen the other primary cutting edge 2 or 3. When the blade sharpening is completed and the sharpened lawnmower blade 6 removed from the blade fixture 20, the spark trap 24 can be removed and the trapped debris properly disposed of.

In the alternate handle design 64 depicted in FIG. 8, once the angle of the sharpening mechanism 19 is set, the user can then utilize the apparatus 10 to clamp a standard lawnmower blade 1 or 9 into the blade fixture 20, sharpen one of the primary edges 2 or 3 of the lawnmower blade 1 or 9, unclamp the lawnmower blade 1 or 9 from the blade fixture 20, rotate the blade 1 or 9 180 degrees, re-clamp the blade 1 or 9 and sharpen the other primary edge 2 or 3 and then unclamp the blade 1 or 9. With this alternative handle 64, in order to sharpen the secondary cutting edges 7 and 8 of a mulching type blade 6 the user needs to sharpen both primary edges 2 and 3 and then loosen the split bar clamp 47 by loosening the screw 49 (shown in FIG. 9), rotate the handle shaft 17 to the proper angle and tighten the split bar clamp screw 49 thereby tightening the split bar clamp 47 about the handle shaft 17. The user can then sharpen the secondary cutting edges 7 and 8 by powering up the sharpening mechanism 19 and drawing the sharpening mechanism 19 over a secondary cutting edge 7 or 8, unclamping the blade 6, rotate the blade 6 180 degrees, re-clamping the blade 6 in the blade fixture 20, powering up the sharpening mechanism 19 and drawing the sharpening mechanism 19 over the other secondary edge 7 or 8 and then unclamping the blade 6.

Figure 14:
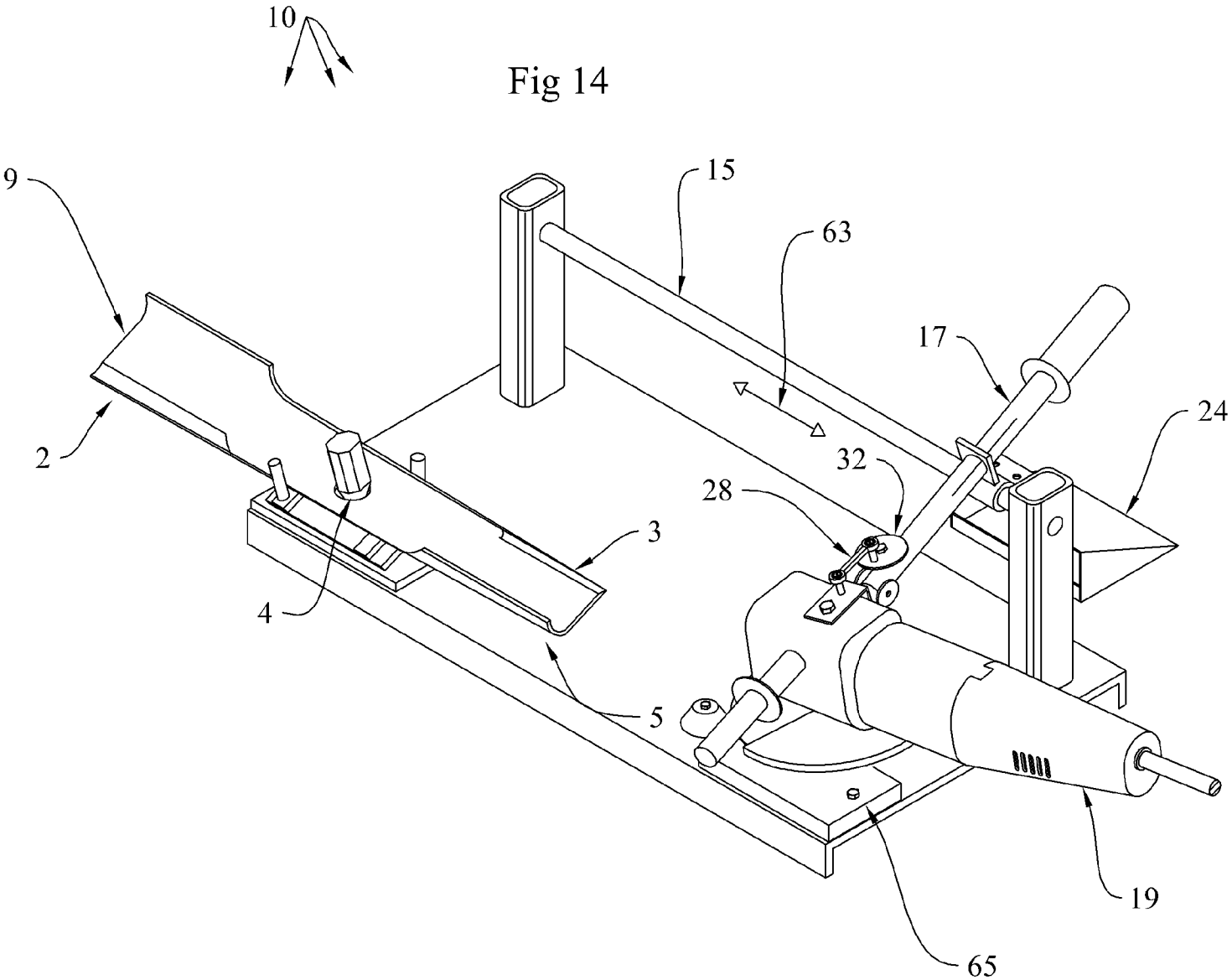
FIG. 14 is a perspective view of the present invention with a counter-clockwise rotating standard blade mounted into the blade fixture.

FIG. 14 depicts the apparatus 10 setup to sharpen counter-clockwise rotating blades 9. To convert the apparatus 10 from being utilized to sharpen clockwise rotating blades 1 or 6 to utilizing the apparatus 10 to sharpen counter-clockwise rotating blades 9, or vice versa, a user removes the two bolts 52 (only one of which is shown in FIGS. 4 and 10) which attach the blade fixture 20 to the base 12, rotates the blade fixture 20 180 degrees and re-attaches the bolts 52 through the blade fixture 20 to secure the blade fixture 20 into its new position on the base plate 12. Counter-clock wise rotating blades, of either the standard or mulching type can now be sharpened in a manner similar the method described above for sharpening clockwise rotating blades.

Figure 2:
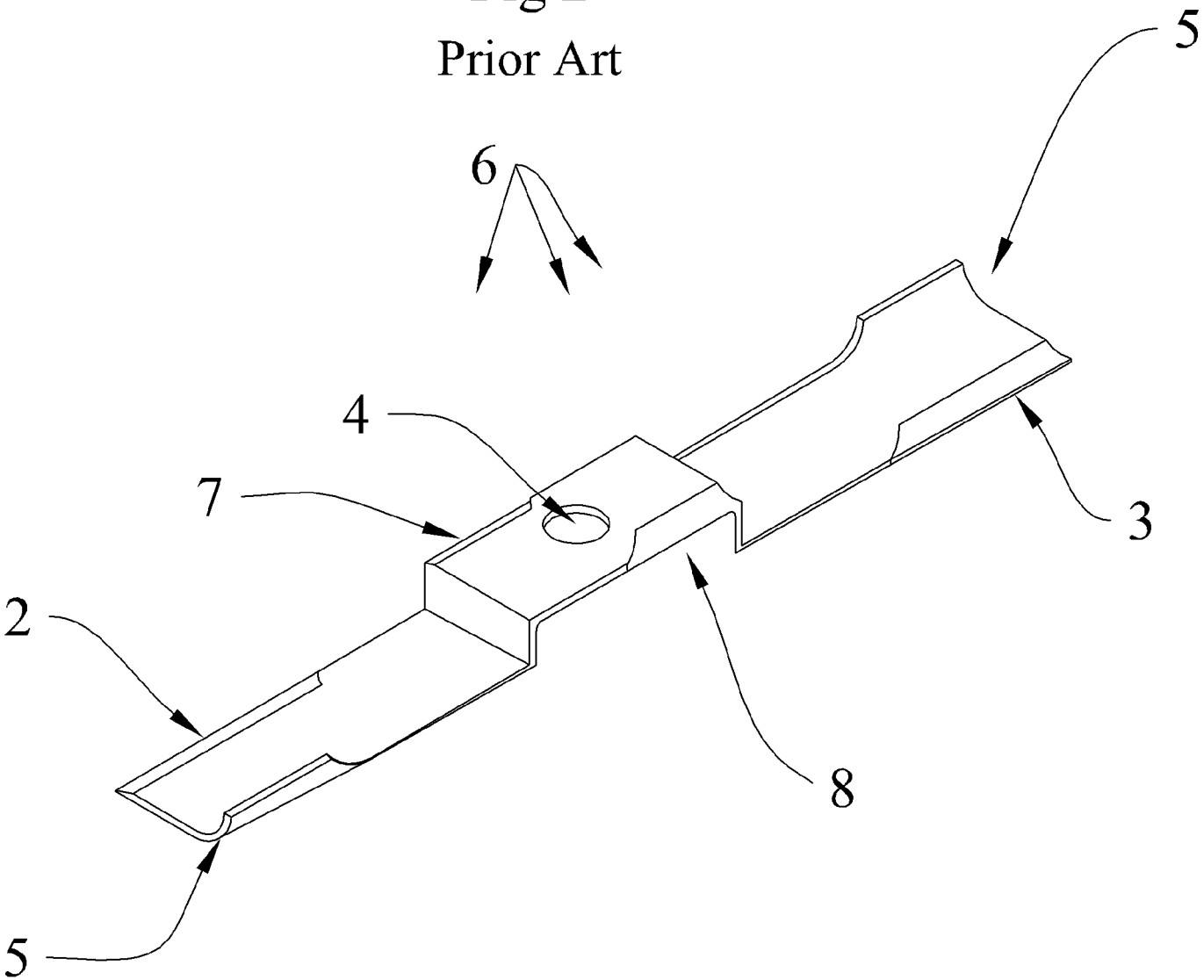
Fig 2 Prior Art
FIG. 2 is a perspective view of a prior art clockwise rotating mulching lawnmower blade.
Figure 3:
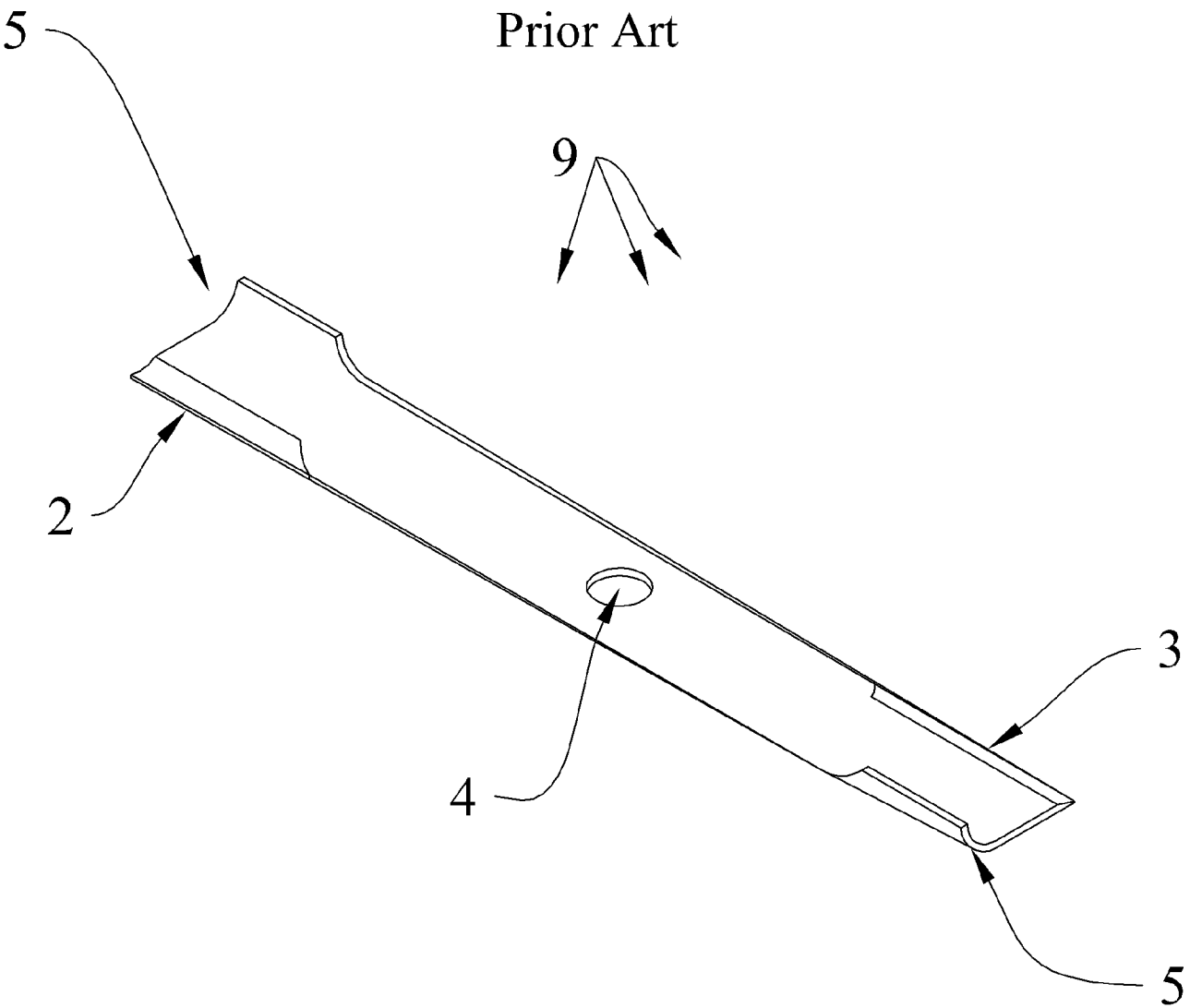
Fig 3 Prior Art
FIG. 3 is a perspective view of a prior art counter-clockwise rotating standard lawnmower blade.

The tapered blade fixture adapter 22, shown in FIG. 4, is inserted into the blade mounting hole 4, shown in FIGS. 1, 2 and 3, when the blade mounting hole 4 is larger than the blade clamp 58. This allows the blade clamp 58 to secure the blade and fixture adapter 22 to the blade fixture 20.

Although the preferred embodiments of the invention has been described using specific terms, devices and drawings, such description is for illustrative purposes only. The words and terminology used are words of description rather than of limitation. It is to be understood that changes and variations may be made by those of ordinary skill in the art without departing from spirit and scope of the present invention, which is set forth in the following claims. Therefore, the spirit and scope of the appended claims should not be limited to the description of the preferred embodiments contained herein.

We claim:

1. An apparatus for sharpening clockwise rotating standard blades and counter-clockwise rotating standard blades, comprising:

an apparatus base;

a blade fixture removably attached to said apparatus base in one of a first position when sharpening clockwise rotating standard blades and removably attached in a second position when sharpening counter-clockwise rotating standard blades, wherein said blade fixture comprises:

a fixture base plate with removable attachment for securing said blade fixture to said apparatus base in one of said first and said second positions on said apparatus base;

a first set of uprights attached to said fixture base plate at a first end of said first uprights;

a blade fixture plate attached to said first set of uprights at a second end of said first uprights, said blade fixture plate attached at an angle to said fixture base plate;

a plurality of blade stop assemblies slideably attached to said blade fixture plate, said blade stop assemblies comprising a bar, a blade stop pin, a guide pin and a securing mechanism; and a blade clamp for holding a blade within the blade fixture during grinding, the blade clamp having a removable attachment for securing said blade clamp to said blade fixture plate;

a pair of second uprights attached to said apparatus base;

a slide shaft, said slide shaft extending laterally between said second uprights;

a slide bushing rotatably and slideably attached to said slide shaft;

a releasable bar clamp attached to said slide bushing;

a handle shaft adjustably mounted to said bar clamp, said handle shaft having a first and second end;

a handle grip attached to said first end of said handle shaft; and a sharpening mechanism attached to said second end of said handle shaft.

2. The apparatus for sharpening blades as in claim 1, wherein said blade is a lawnmower blade.

3. The apparatus for sharpening blades as in claim 1, wherein said sharpening mechanism comprises a grinder.

4. The apparatus for sharpening blades as in claim 1, further comprising a spark trap removably attached to said slide bushing.

5. The apparatus for sharpening blades as in claim 1, further comprising:

a removable tapered blade fixture adapter removably attached to said apparatus base, wherein:

any one of said blades is removably attached to said blade fixture;

said blade fixture adapter is removably placed into a blade mounting hole on any one of said blades on said blade fixture;

said blade clamp is inserted through said blade fixture adapter and said blade mounting hole; and said blade clamp is removable attached to said blade fixture plate.

6. The apparatus for sharpening blades as in claim 1, further comprising:

a single first scribe mark on said handle shaft for use in setting an angle on said handle shaft and said sharpening mechanism; and a plurality of second scribe marks on the face of said bar clamp for determining the angle of said handle shaft and said sharpening mechanism.

7. The apparatus for sharpening blades as in claim 1, further comprising:

a spring loaded detent ball attached to said handle shaft;

an adjusting wheel rotatably attached to said handle shaft, said adjusting wheel being in selective contact with said detent ball;

a first post with first and second ends, said first post attached at said first end to a position offset to the center of said adjusting wheel;

a pivotable coupling with first and second ends, said pivotal coupling attached at said pivotal coupling first end to said second end of said first post;

said pivotal coupling attached at said second end to a first end of a second post;

a second end of said second post being attached to an angled bracket;

said angled bracket being attached at a first end to said sharpening mechanism and at a second end to said handle shaft.

8. The apparatus for sharpening blades as in claim 1, further comprising a sharpening mechanism rest attached to said apparatus base.

9. The apparatus for sharpening blades as in claim 8, wherein said rest is formed of materials selected from the group of materials consisting of nylon, polyurethane, phenolic resins, plastic and rubber.

10. An apparatus for sharpening clockwise rotating blades and counter-clockwise rotating blades and standard and mulching type blades wherein said standard blades have primary cutting edges and said mulching blades have said primary and additional secondary cutting edges, said secondary cutting edges being on a separate horizontal plane parallel to said primary cutting edges, said apparatus comprising:

an apparatus base;

a blade fixture removably attached to said apparatus base in one of a first position when sharpening clockwise rotating blades and removably attached in a second position when sharpening counter-clockwise rotating blades, wherein said blade fixture comprises:

a fixture base plate with removable attachment for securing said blade fixture to said apparatus base in one of said first and said second positions on said apparatus base;

a first set of uprights attached to said fixture base plate at a first end of said first uprights;

a blade fixture plate attached to said first set of uprights at a second end of said first uprights, said blade fixture plate attached at an angle to said fixture base plate;

a plurality of blade stop assemblies slideably attached to said blade fixture plate, said blade stop assemblies comprising a bar, a blade stop pin, a guide pin and a securing mechanism; and a blade clamp for holding a blade within the blade fixture during grinding, the blade clamp having a removable attachment for securing said blade clamp to said blade fixture plate;

a pair of second uprights attached to said apparatus base;

a slide shaft, said slide shaft extending laterally between said second uprights;

a slide bushing rotatably and slideably attached to said slide shaft;

a releasable bar clamp attached to said slide bushing;

a handle shaft adjustably mounted to said bar clamp, said handle shaft having a first and second end;

a handle grip attached to said first end of said handle shaft;

a spring loaded detent ball attached to said handle shaft;

an adjusting wheel rotatably attached to said handle shaft, said adjusting wheel being in selective contact with said detent ball;

a first post with first and second ends, said first post attached at said first end to a position offset to the center of said adjusting wheel;

a pivotable coupling with first and second ends, said pivotal coupling attached at said first end to said second end of said first post;

said pivotal coupling attached at said second end to a first end of a second post;

a second end of said second post being attached to an angled bracket; and said angled bracket being attached at a first end to said sharpening mechanism and at a second end to said handle shaft.

11. The apparatus for sharpening blades as in claim 10, wherein said blade is a lawnmower blade.

12. The apparatus for sharpening blades as in claim 10, wherein said sharpening mechanism comprises a grinder.

13. The apparatus for sharpening blades as in claim 10, further comprising a spark trap removably attached to said slide bushing.

14. The apparatus for sharpening blades as in claim 10, further comprising:

a removable tapered blade fixture adapter removably attached to said apparatus base, wherein:

any one of said blades is removably attached to said blade fixture;

said blade fixture adapter is removably placed into a blade mounting hole on any one of said blades on said blade fixture;

said blade clamp is inserted through said blade fixture adapter and said blade mounting hole; and said blade clamp is removable attached to said blade fixture plate.

15. The apparatus for sharpening blades as in claim 10, further comprising:

a single first scribe mark on said handle for use in setting the angle on said handle shaft and said sharpening mechanism; and a plurality of second scribe marks on the forward face of said bar clamp for determining the angle of said handle shaft and said sharpening mechanism.

16. The apparatus for sharpening blades as in claim 10, further comprising a sharpening mechanism rest attached to said apparatus base.

17. The apparatus for sharpening blades as in claim 16, wherein said rest is formed of materials selected from the group of materials consisting of nylon, polyurethane, phenolic resins, plastic and rubber.

18. A method for sharpening the primary cutting edge of clockwise rotating standard blades and counter-clockwise rotating standard blades, comprising the steps of:

providing an apparatus comprising:

an apparatus base;

a blade fixture removably attached to said apparatus base in one of a first position when sharpening clockwise rotating standard blades and removably attached in a second position when sharpening counter-clockwise rotating standard blades, wherein said blade fixture comprises:

a fixture base plate with removable attachment for securing said blade fixture to said apparatus base in one of said first and said second positions on said apparatus base;

a first set of uprights attached to said fixture base plate at a first end of said first uprights;

a blade fixture plate attached to said first set of uprights at a second end of said first uprights, said blade fixture plate attached at an angle to said fixture base plate;

a plurality of blade stop assemblies slideably attached to said blade fixture plate, said blade stop assemblies comprising a bar, a blade stop pin, a guide pin and a securing mechanism; and a blade clamp with removable attachment for securing said blade clamp to said blade fixture plate;

a pair of second uprights attached to said apparatus base;

a slide shaft, said slide shaft extending laterally between said second uprights;

a slide bushing rotatably and slideably attached to said slide shaft;

a releasable bar clamp attached to said slide bushing;

a handle shaft adjustably mounted to said bar clamp, said handle shaft having a first and second end;

a handle grip attached to said first end of said handle shaft; and a sharpening mechanism attached to said second end of said handle shaft;

a. removably attaching said clockwise rotating standard blade in the blade fixture, said blade fixture temporarily retaining said clockwise rotating standard blade at a primary angle, said blade fixture being removably attached in one of a first and second position on the blade sharpening apparatus;

b. positioning the sharpening mechanism at a first cutting angle for blade sharpening;

c. sharpening a primary cutting edge on said clockwise rotating standard blade by engaging said blade sharpening mechanism on said primary cutting edge of said clockwise rotating standard blade;

d. removing said clockwise rotating standard blade;

e. removing said blade fixture from said first position on said blade sharpening apparatus and removably attaching said blade fixture in said second position on said blade sharpening apparatus;

f. removably attaching said counter-clockwise rotating standard blade in said blade fixture;

g. sharpening a primary cutting edge of said counter-clockwise rotating standard blade by engaging said blade sharpening mechanism on said primary edge of counter-clockwise rotating standard blade; and h. removing said counter-clockwise rotating standard blade.

19. The method as in claim 18, wherein said clockwise rotating standard blades and said counter-clockwise rotating standard blades are lawnmower blades.

20. The method as in claim 18, wherein said sharpening mechanism comprises a grinder.

21. The method as in claim 18, wherein:

positioning the sharpening mechanism step further comprises:

b1. attaching a removable spark trap onto said slide bushing;

and wherein sharpening said counter-clockwise rotating standard blade step further comprises:

g1. removing said spark trap;

g2. properly disposing of the debris in said spark trap; and g3. re-attaching said spark trap onto said slide bushing.

22. The method as in claim 18, wherein said positioning step further comprises the steps of:

b1. loosening said screw in said bar clamp;

b2. rotating said handle shaft until said sharpening mechanism is in a proper cutting angle; and b3. tightening said screw in said split bar clamp to hold said handle shaft and said sharpening mechanism in said cutting angle.

23. The method as in claim 18, further comprising a sharpening mechanism rest attached to said apparatus base.

24. The method as in claim 23, wherein said rest is formed of materials selected from the group of materials consisting of nylon, polyurethane, phenolic resins, plastic and rubber.

25. A method for sharpening standard clockwise rotating blades, standard counter-clockwise rotating blades, mulching clockwise rotating blades and mulching counter-clockwise rotating blades wherein said standard blades have primary cutting edges and said mulching blades have said primary and additional secondary cutting edges, said secondary cutting edges being on a separate horizontal plane parallel to said primary cutting edges, said method comprising:

providing an apparatus comprising:

an apparatus base;

a blade fixture removably attached to said apparatus base in one of a first position when sharpening clockwise rotating standard blades and removably attached in a second position when sharpening counter-clockwise rotating standard blades, wherein said blade fixture comprises:

a fixture base plate with removable attachment for securing said blade fixture to said apparatus base in one of said first and said second positions on said apparatus base;

a first set of uprights attached to said fixture base plate at a first end of said first uprights;

a blade fixture plate attached to said first set of uprights at a second end of said first uprights, said blade fixture plate attached at an angle to said fixture base plate;

a plurality of blade stop assemblies slideably attached to said blade fixture plate, said blade stop assemblies comprising a bar, a blade stop pin, a guide pin and a securing mechanism; and a blade clamp with removable attachment for securing said blade clamp to said blade fixture plate;

a pair of second uprights attached to said apparatus base;

a slide shaft, said slide shaft extending laterally between said second uprights;

a slide bushing rotatably and slideably attached to said slide shaft;

a releasable bar clamp attached to said slide bushing;

a handle shaft adjustably mounted to said bar clamp, said handle shaft having a first and second end;

a handle grip attached to said first end of said handle shaft; and a sharpening mechanism attached to said second end of said handle shaft;

a spring loaded detent ball attached to said handle shaft;

an adjusting wheel rotatably attached to said handle shaft, said adjusting wheel being in selective contact with said detent ball;

a first post with first and second ends, said first post attached at said first end to a position offset to the center of said adjusting wheel;

a pivotable coupling with first and second ends, said pivotal coupling attached at said first end to said second end of said first post;

said pivotal coupling attached at said second end to a first end of a second post;

a second end of said second post being attached to an angled bracket; and said angled bracket being attached at a first end to said sharpening mechanism and at a second end to said handle shaft, a. removably attaching said standard clockwise rotating blade in the blade fixture, said blade fixture temporarily retaining said blade at a primary angle, said blade fixture being removably attached in one of a first and second position on the blade sharpening apparatus;

b. positioning the sharpening mechanism at a first cutting angle for blade sharpening;

c. sharpening said primary cutting edge of said standard clockwise rotating blade by engaging said sharpening mechanism on said primary cutting edge of said standard clockwise rotating blade;

d. removing said standard clockwise rotating blade from said blade fixture;

e. removably mounting said clockwise rotating mulching blade to said blade fixture;

f. sharpening said primary cutting edge on said clockwise rotating mulching blade by engaging said sharpening mechanism on said primary edge of said clockwise rotating mulching blade;

g. turning said adjusting wheel from a first position to a second position which causes said offset pivotal coupling to move causing said sharpening mechanism to change to a second cutting angle;

h. sharpening said secondary cutting edge on said clockwise rotating mulching blade by engaging said sharpening mechanism on said secondary edge of said clockwise rotating mulching blade;

i. removing said clockwise rotating mulching blade from said blade fixture;

j. removing said blade fixture from said first position on said blade sharpening apparatus and removably attaching said blade fixture in said second position on said blade sharpening apparatus;

k. removably mounting a standard counter-clockwise rotating blade in said blade fixture;

l. turning said adjusting wheel from said second position to a third position which causes said offset pivotal coupling to move causing said sharpening mechanism change to a third cutting angle;

m. sharpening said primary cutting edge of said standard counter-clockwise rotating blade by engaging said sharpening mechanism on said primary cutting edge of said counter-clockwise rotating blade;

n. removing said counter-clockwise rotating blade;

o. removably mounting a counter-clockwise rotating mulching blade to said blade fixture;

p. sharpening said primary cutting edge on said counter-clockwise rotating mulching blade by engaging said blade sharpening mechanism on said primary edge of said counter-clockwise rotating mulching blade;

q. turning said adjusting wheel to a fourth position which causes said offset pivotal coupling to move causing said sharpening apparatus to change to a fourth cutting angle;

u. sharpening said secondary cutting edge on said counter-clockwise rotating mulching blade by engaging said sharpening mechanism on said secondary cutting edge of said counter-clockwise rotating mulching blade; and r. removing said counter-clockwise rotating mulching blade from said blade fixture.

26. The method as in claim 25, wherein said clockwise rotating standard blades, clockwise rotating mulching blades, counter-clockwise rotating standard blades and counter-clockwise rotating mulching blades are lawnmower blades.

27. The method as in claim 25, wherein said sharpening mechanism comprises a grinder.

28. The method as in claim 25, wherein:

positioning the sharpening mechanism step further comprises:

b1. attaching a removable spark trap onto said slide bushing;

and wherein removing said counter-clockwise rotating mulching blade step further comprises:

r1. removing said spark trap after sharpening said counter-clockwise rotating blade;

r2. properly disposing of the debris in said spark trap; and r3. re-attaching said spark trap onto said slide bushing.

29. The method as in claim 25, wherein said positioning step further comprises the steps of:

b1. loosening said screw on said bar clamp;

b2. rotating said handle shaft until said grinding mechanism is in said first cutting angle; and b3. tightening said screw in said split bar clamp to hold said handle shaft and said sharpening mechanism in said first cutting angle.

30. The method as in claim 25, further comprising a sharpening mechanism rest attached to said apparatus base.

31. The method for sharpening blades as in claim 30, wherein said rest is formed of materials selected from the group of materials consisting of nylon, polyurethane, phenolic resins, plastic and rubber.

* * * * *